US005967138A

United States Patent [19]

Cacace

[11] Patent Number: 5,967,138

[45] Date of Patent: Oct. 19, 1999

[54] FLASH SUPPRESSOR FOR HOT WATER HEATER

[76] Inventor: Jeffrey Cacace, Two Southview Ct., Huntington, N.Y. 11743

[21] Appl. No.: 09/210,217

[22] Filed: Dec. 11, 1998

[51] Int. Cl.[6] ..... F24H 1/00

[52] U.S. Cl. ..... 126/361; 126/350 R; 126/344; 122/13.1; 122/14

[58] Field of Search ..... 126/350 R, 361, 126/363, 344, 373, 355, 359, 85 B; 122/504, 507, 13.1, 14, 17, 18, 19, 16; 137/312

[56] References Cited

U.S. PATENT DOCUMENTS

| | | | |
|---|---|---|---|
| 2,830,574 | 4/1958 | Shafer | 126/85 B |
| 5,085,205 | 2/1992 | Hall | 126/350 R |
| 5,794,609 | 8/1998 | Grant | 126/363 |
| 5,848,586 | 12/1998 | Garms | 126/350 R |

*Primary Examiner*—James C. Yeung
*Attorney, Agent, or Firm*—Collard & Roe, P.C.

[57] ABSTRACT

A protective collar means for surrounding the lower periphery of a cylindrical water heater. The collar means comprises a cylinder attached at the top and bottom edges to flanged and grooved rings for keeping the cylinder stable. The collar means may be easily assembled by placing the cylinder inside the flange of the lower ring and placing the flange of the upper ring on top of the cylinder. The collar means is preferably secured by a plurality of springs, which attach to the upper and lower rings to keep the collar means assembled. The collar means is spaced away from the walls of the water heater so as to ensure adequate ventilation of the air space surrounding the water heater, but is close enough to contain any fires or explosions that may occur near the gas flames.

6 Claims, 2 Drawing Sheets

FLASH SUPPRESSOR FOR HOT WATER HEATER

BACKGROUND OF THE INVENTION

1. Field of the Invention

This invention relates to a protective covering for a gas-fueled water heater. In particular, the invention relates to a collar for surrounding the lower periphery of a cylindrical gas-fueled water heater, to prevent spills on the floor from contacting the water heater and to contain any explosions or fires resulting from the ignition of fumes by the heater's gas flame.

2. The Prior Art

Natural gas-fueled water heaters have become very common in households, due to the efficiency and low cost of natural gas. One problem that has developed as a result of these water heaters, however, is the danger of fire and explosion from fumes and/or spills contacting the gas flames at the bottom of the water heater. These explosions and fires can cause substantial property damage, injury to household occupants, and even death. One proposed solution has been to elevate the water heater approximately 18 inches off of the floor. The drawbacks of this solution are that often there is insufficient headroom to elevate the heater in a small, low basement, or that the required revisions to the pipe system connected to the heater make the elevation unfeasible and too expensive.

SUMMARY OF THE INVENTION

It is therefore an object of the present invention to overcome the drawbacks of the prior art and to provide means for preventing explosions and fires resulting from the contact of fumes or flammable liquids with the gas flames in water heaters.

It is another object of the invention to provide a means for preventing such fires and explosions without moving or changing the configuration of the water heater.

It is yet another object of the present invention to provide a means for preventing such fires and explosions that is easy to assemble, inexpensive and removable.

These and other objects and features of the present invention are accomplished by a protective collar means for surrounding the lower periphery of a cylindrical water heater. The collar means comprises a cylinder attached at the top and bottom edges to flanged rings for keeping the cylinder stable.

The cylinder is preferably made from aluminum, but may be manufactured from any lightweight, inexpensive, pliable, heat-resistant material. The rings are preferably formed from heavy gauge aluminum or light gauge steel, but other suitable materials could be envisioned. The rings should be made of a suitably rigid and heat-resistant material.

The collar means may be easily assembled by placing the cylinder inside the flange of the lower ring and placing the flange of the upper ring on top of the cylinder. The collar means is preferably secured by a plurality of springs, which attach to the upper and lower rings to keep the collar means assembled. Other means for securing the assembly could also be used, such as individual clamps that attach each ring to the cylinder.

After the collar means is assembled around a water heater, the bottom ring is preferably cemented to the floor, to seal out any spills that may occur in the surrounding area.

In a preferred embodiment, the collar means is approximately 18 inches tall and the rings are approximately 2 inches wide. The collar means is preferably spaced approximately 6–12 inches away from the walls of the water heater, to ensure adequate ventilation of the air space surrounding the water heater, but is close enough to contain any fires or explosions that may occur near the gas flames.

The collar means may be easily installed by assembling the rings and cylinder around the heater. The rings and cylinder are each made of two halves, each of which can be assembled around the water heater. Preferably, one end of each half is hollow and the other end of each half has an elongated arm that can slidably fit within the hollow portion of the other arm to assemble the rings around the water heater. This construction also enables the collar means to be adjustable to fit various sizes of water heaters. Other methods of assembly could also be envisioned.

BRIEF DESCRIPTION OF THE DRAWINGS

Other objects and features of the present invention will become apparent from the following detailed description considered in connection with the following drawings. It is to be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENTS

Figure 1:
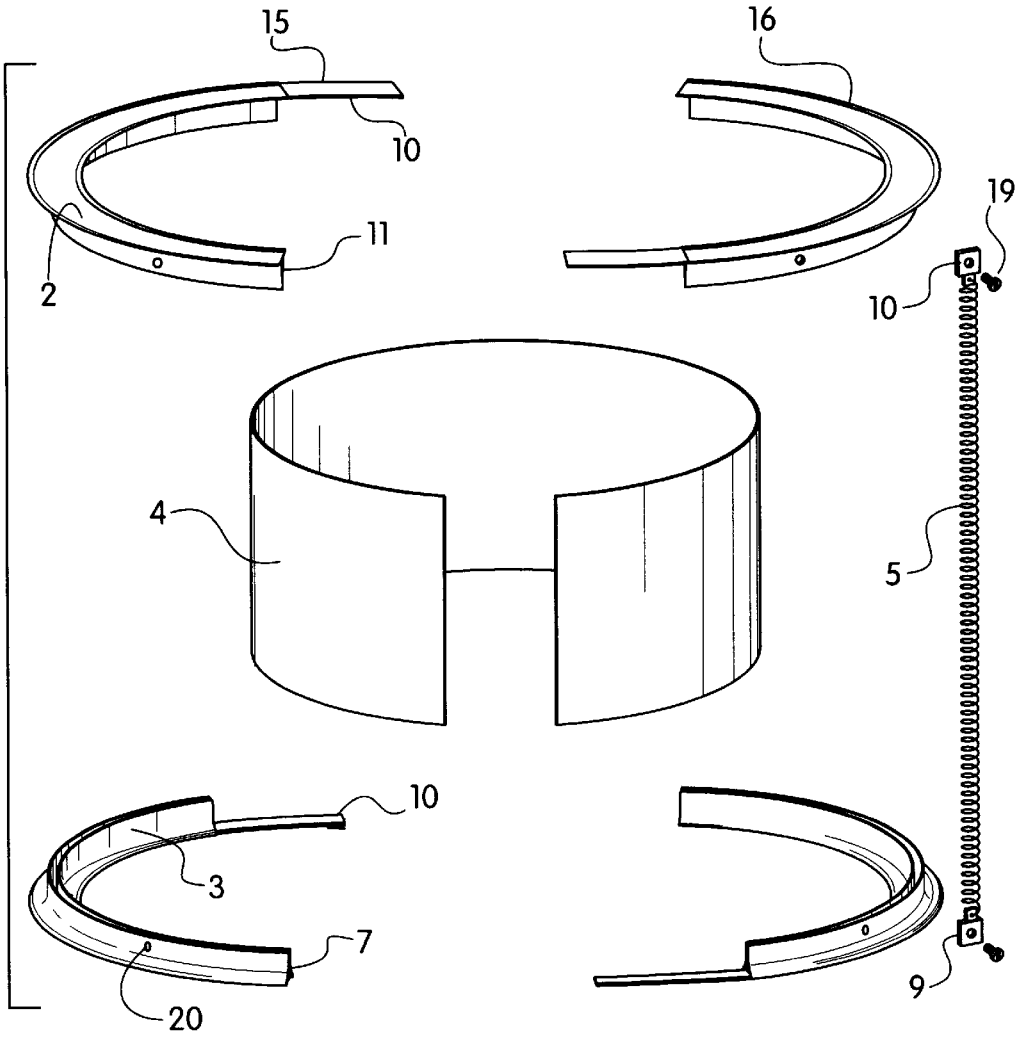
FIG. 1 is a side perspective view of the various parts of the invention in the disassembled state.
Figure 3:
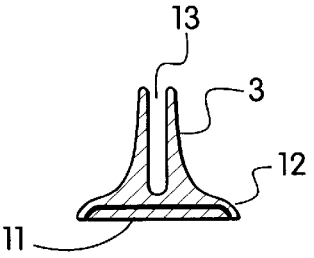
FIG. 3 is a cross-sectional view of the bottom ring along line A—A of FIG. 2.
Figure 4:
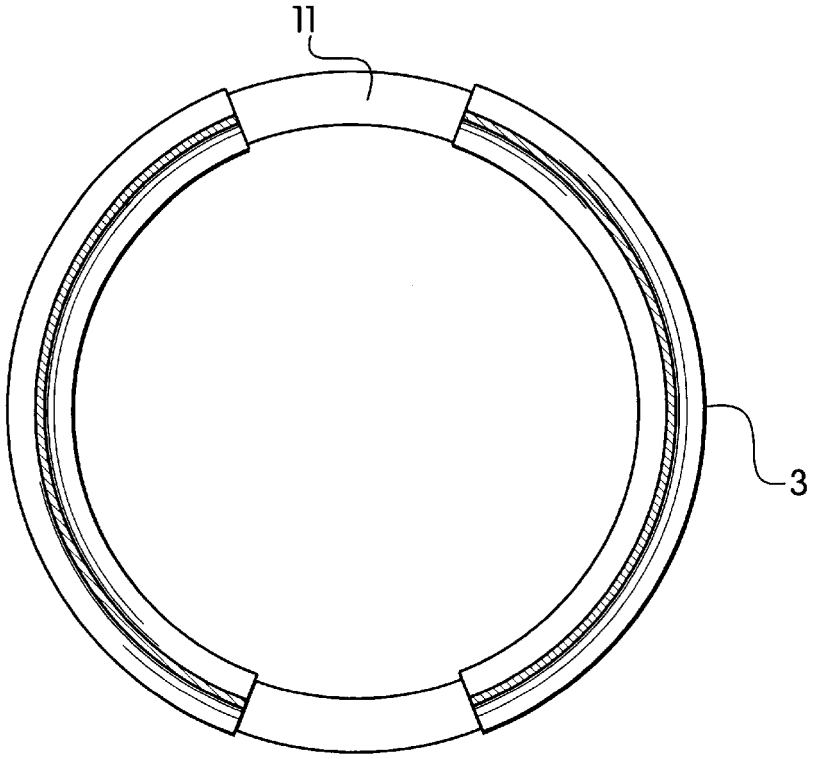
FIG. 4 is a top view of the ring shown in FIG. 2.
Figure 5:
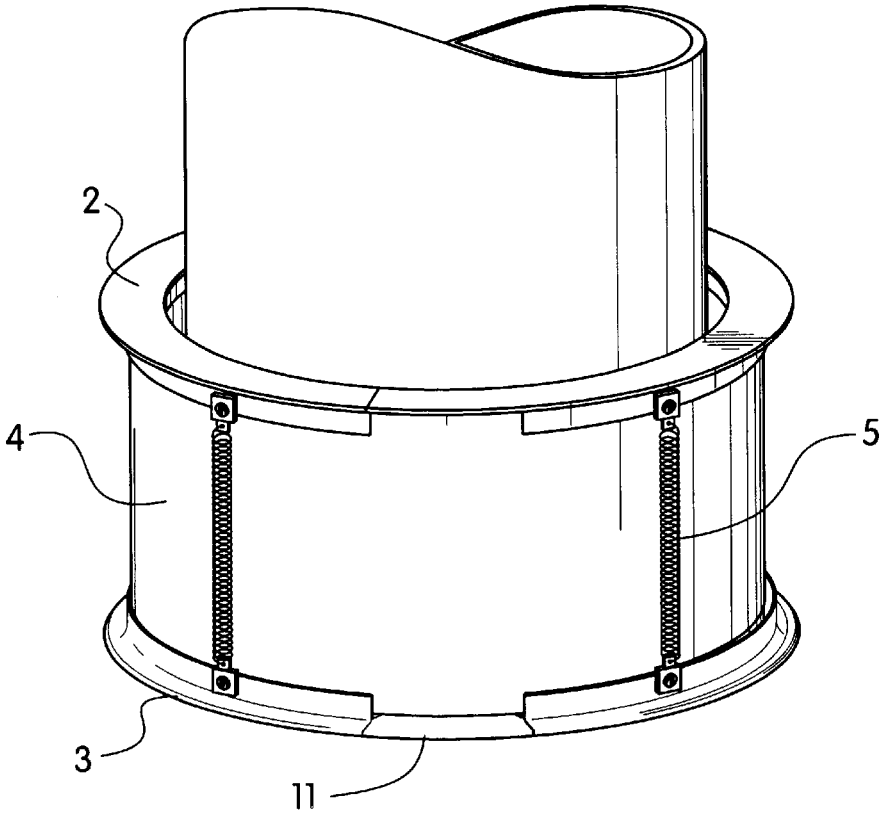
FIG. 5 is a side perspective view of the present invention assembled around a water heater.

Turning now in detail to the drawings, and in particular, FIG. 1, there is shown the disassembled collar means 1, which is comprised of top ring 2, bottom ring 3, cylinder 4 and spring 5. Top ring 2 is comprised of two halves, each having a downwardly extending flange 6. Bottom ring 3 is also in two halves, each half having upwardly extending flange 7. Top ring 2 and bottom ring 3 are identical and may be interchanged with one another. As shown in FIGS. 3 and 4, flanges 6 and 7 each have a center groove 13 in which the rim of cylinder 4 rests when the collar means is assembled.

To keep collar means assembled and stable, spring 5 is attached with brackets 9 and 10 to top ring 2 and bottom ring 3. Preferably, four springs are used to keep the assembly intact. Brackets 9 and 10 are secured with screws 19 that fit through holes 20 which have been drilled into the sides of top ring 2 and bottom ring 3. Spring 5 secures top ring 2 and bottom ring 3 firmly to cylinder 4 and keeps collar means 1 in place during use.

As shown in FIG. 4, collar means 1 surrounds a standard gas-fueled water heater and prevents spills from coming into contact with the open flame located at the bottom of the water heater. In addition, any small fires or explosions that could occur from the flame are contained within the collar and prevent injury to occupants and damage to the surrounding area.

Figure 2:
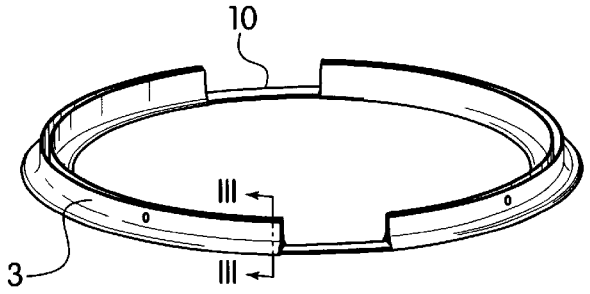
FIG. 2 is a side perspective view of the bottom ring as assembled of the embodiment shown in FIG. 1.

As shown in FIGS. 1 and 3, collar means 1 is adjustable for differing widths of water heaters. The adjustability is accomplished by cutting cylinder 4 to the desired circumference with suitable heavy-duty shears or a saw. The upper and lower rings are adjustable because they are comprised of two halves 15 and 16, having each having an arm 11 and a sleeve 12. Arms 11 are slidably inserted into sleeves 12 to obtain the desired circumference, as shown in FIG. 2.

Accordingly, while only several embodiments of the present invention have been shown and described, it is obvious that many changes and modifications may be made thereunto without departing from the spirit and scope of the invention.

What is claimed is:

1. A protective collar means for surrounding the lower periphery of a cylindrical gas-powered water heater, comprising:

a cylinder having a top edge and a bottom edge;

a top ring and a bottom ring, each ring comprising a base, a flange extending outwardly from the base, and a groove within the flange, so that the bottom edge of the cylinder is engaged by the groove in the bottom ring and the top edge of the cylinder is engaged by the groove in the top ring; and means for securing the top rings and bottom ring to the cylinder, wherein the collar means is spaced away from the water heater to permit ventilation of the space around the water heater while containing any fires or explosions within the collar means and also preventing spills in the area of the water heater from coming into contact with the water heater.

2. The collar means of claim 1 wherein the collar means has a radius that is between 6 and 12 inches larger than the radius of the water heater.

3. The collar means of claim 1 wherein the collar means is about 18 inches tall.

4. The collar means of claim 1 wherein the means for securing the top ring and bottom ring to the cylinder comprises a plurality of springs, each spring having a top end and a bottom end, wherein the top end of each spring is attached to the top ring and the bottom end of each spring is attached to the bottom ring.

5. The collar means of claim 4 further comprising a bracket having a screw hole attached to the top and bottom ends of each spring, screw holes in the top and bottom rings, screws and nuts, wherein the spring is secured to the top and bottom rings by a screw inserted through each top bracket and bottom bracket into a corresponding hole in the top and bottom rings.

6. The collar means of claim 1, wherein each of said top and bottom rings are comprised of two halves, each half having two ends, with a longitudinally-extending hollow portion at one end and a longitudinally-extending arm at the other end, wherein the longitudinally-extending arm of one half of a ring is adapted to slidably insert within the hollow portion of the other half of a ring to form a completed ring that is slidably adjusted to obtain the desired circumference.

* * * * *